US007396140B2

(12) United States Patent
Cai

(10) Patent No.: US 7,396,140 B2
(45) Date of Patent: Jul. 8, 2008

(54) PORTABLE READING LAMP

(76) Inventor: Jianping Cai, Aoneng Buliding, Lunjiao Luduan, Guangzhu Gonglu, Shunde, Guandong (CN)

( * ) Notice: Subject to any disclaimer, the term of this patent is extended or adjusted under 35 U.S.C. 154(b) by 173 days.

(21) Appl. No.: 11/034,574

(22) Filed: Jan. 13, 2005

(65) Prior Publication Data

US 2005/0152135 A1 Jul. 14, 2005

(30) Foreign Application Priority Data

Jan. 13, 2004 (CN) ..... 2004 2 0014650 U

(51) Int. Cl.
*F21V 9/10* (2006.01)

(52) U.S. Cl. ..... 362/167; 362/190; 362/227; 362/800

(58) Field of Classification Search ..... 362/226, 362/183, 800, 382, 414, 190
See application file for complete search history.

(56) References Cited

U.S. PATENT DOCUMENTS 4,388,673 A * 6/1983 Maglica ..... 362/183
5,169,226 A * 12/1992 Friedman ..... 362/190
5,645,341 A * 7/1997 Liao ..... 362/183
5,695,271 A * 12/1997 Zeller ..... 362/98
5,980,070 A * 11/1999 Hulse et al. ..... 362/385
6,005,254 A * 12/1999 Wijtsma et al. ..... 250/494.1
6,113,250 A * 9/2000 Lin ..... 362/287
6,599,000 B2 * 7/2003 Nolan et al. ..... 362/414
6,712,489 B2 * 3/2004 Durkin ..... 362/358
6,736,531 B2 * 5/2004 Wallach ..... 362/414
6,776,496 B2 * 8/2004 Cok ..... 362/84
2004/0145890 A1 * 7/2004 Liao ..... 362/183
2006/0072328 A1 * 4/2006 Chan ..... 362/382

* cited by examiner

*Primary Examiner*—Anabel M Ton
(74) *Attorney, Agent, or Firm*—Merchant & Gould P.C.

(57) ABSTRACT

A portable reading lamp of the invention comprises a base, a head portion and a pole to connect the base with the head portion. The head portion is provided with the luminant, which is semiconductor LED. A battery box is provided on the base, the head portion or the pole for supplying direct current. The semiconductor LED is used as the luminant in the invention, so the reading lamp of the invention can save energy in high-efficiency (10% electricity consumption of the traditional reading lamp), which also has the following strongpoint: saturated color and ray, infinite motley, switching rapidly, unpolluted, shock-resistant, dampness-resistant, long usage life (100,000 hours), radiation-free and less maintenance. The invention also provides a battery box in the base for supplying direct current, which is very convenient to be used in the field when no external power source can be used.

10 Claims, 4 Drawing Sheets

PORTABLE READING LAMP

FIELD OF THE INVENTION

The present invention is related to a head lamp, and more particularly to a portable reading lamp.

BACKGROUND OF THE INVENTION

At present, there are many kinds of reading lamps, each of which is mainly consisted of a base, a head portion and a pole connecting the base with the head portion. On the head portion there is an illuminant mounted which can be an incandescent bulb, a solar bulb or the like. However, the traditional reading lamps are all applied to alternative voltage so that it is discommodious to be taken. In addition, frequency flash can frequently occur to the lamps during usage so as to hurt user's eyes. Also, the incandescent bulb and the fluorescent lamp have the disadvantage of short usage life, frangibility, low luminance, glaring, large electricity consumption, etc. Moreover, the pole of the traditional reading lamp is a kind of flectional soft-tube structure in order to change the angle and position of the head portion relative to the pole and the base. Notwithstanding the head portion and the pole can change their angle and be bent, the head portion, the pole and the base cannot be tightly combined together (such as folding), Thus a larger space will be occupied during transportation and schlepping which results in much inconvenience.

Hence it is desired to provide a portable reading lamp which can overcome the foregoing drawbacks of the prior art.

SUMMARY OF THE INVENTION

A main object of the present invention is to provide a portable reading lamp having an long usage-life illuminant and without the problem of frequency flash.

To achieve the above-mentioned object, a portable reading lamp of the invention comprises a base, a head portion and a pole to connect the base with the head portion. The head portion is provided with the luminant, which is semiconductor light-emitting diode. A battery box is provided on the base, the head portion or the pole for supplying direct current.

In an embodiment, the head portion further comprises a motherboard and a cover, a plurality of holes provided on the motherboard arrayed in a certain manner, the semiconductor light-emitting diodes are parallel connection to a circuit board electrically, which are embedded in the holes respectively. In an embodiment, the hole is a subulate hole. The base is provided at one end with a switch means for adjusting amount of semiconductor light-emitting diodes.

In another embodiment, the base is provided at one end with a charger jack. The base is provided at one end with a charge indicator light and a discharge indicator light. The head portion and the pole are connected by a first turning structure. The base and the pole are connected by a second turning structure.

In a further embodiment of the present invention, the first turning structure comprises a threaded turning shaft with two through holes which connected with the head portion; two bolts connected with the pole; wherein the threaded turning shaft is connected with the head portion through a friction patch, a dishing spring, a lock washer and a screw cap hitched thereon; one of the bolt is connected with the threaded turning shaft through a friction patch, a dishing spring, a lock cushion and a screw cap hitched thereon; the other bolt is connected with the threaded turning shaft through the block spring hitched thereon.

In an embodiment of the present invention, the second turning structure comprises a threaded turning shaft and a base turning shaft both connected with the base; wherein the threaded turning shaft is connected with the pole through a lock patch hitched thereon, the base turning shaft is connected with the pole through a lock patch, a dishing spring and a screw cap hitched thereon. In another embodiment, the pole is a telescopic pole, which may be consisted of at least two sleeves with different sizes assembled together. In a further embodiment, a pole slot is provided in the top of the base for receiving the pole.

Compared with the prior art, the semiconductor LED is used as the luminant in the invention, so the reading lamp of the invention can save energy in high-efficiency (10% electricity consumption of the traditional reading lamp), which also has the following strongpoint: saturated color and ray, infinite motley, switching rapidly, unpolluted, shock-resistant, dampness-resistant, long usage life (100,000 hours), radiation-free and less maintenance. The invention also provides a battery box in the base for supplying direct current, which is very convenient to be used in the field when no external power source can be used. The turning structure connection between the head portion and the pole, and also between the base and the pole will make the head portion change its angle relative to the pole, and also make the pole change its angle and distance relative to the base. A telescopic pole used as the pole and a pole slot provided in top of the base for receiving the pole will make the head portion, the pole and the base can be combined together tightly so that the reading lamp is convenient to be transported or taken, even used as a electric torch.

For the purpose of making the invention easier to understand, one particular embodiment thereof will now be described with reference to the appended drawings in which:

DETAILED DESCRIPTION OF THE INVENTION

Figure 1:
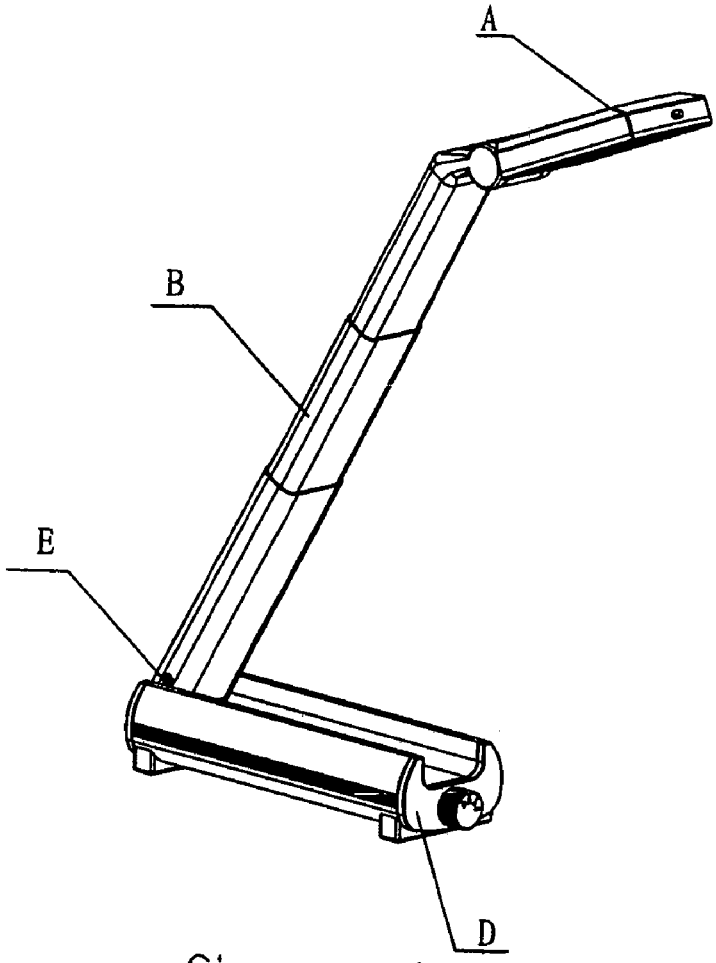
FIG. 1 is a view to show a reading lamp of the invention in an open status.

Referring now to the drawing in detail, as shown in FIG. 1, according to an embodiment of the present invention, a portable reading lamp is consisted of a base D,a head portion A and a pole B to connect the base D with the head portion A. The head portion A and the pole B are jointed through a first turning structure C, while the base D and the pole B are jointed through a second turning structure E.

Figure 3:
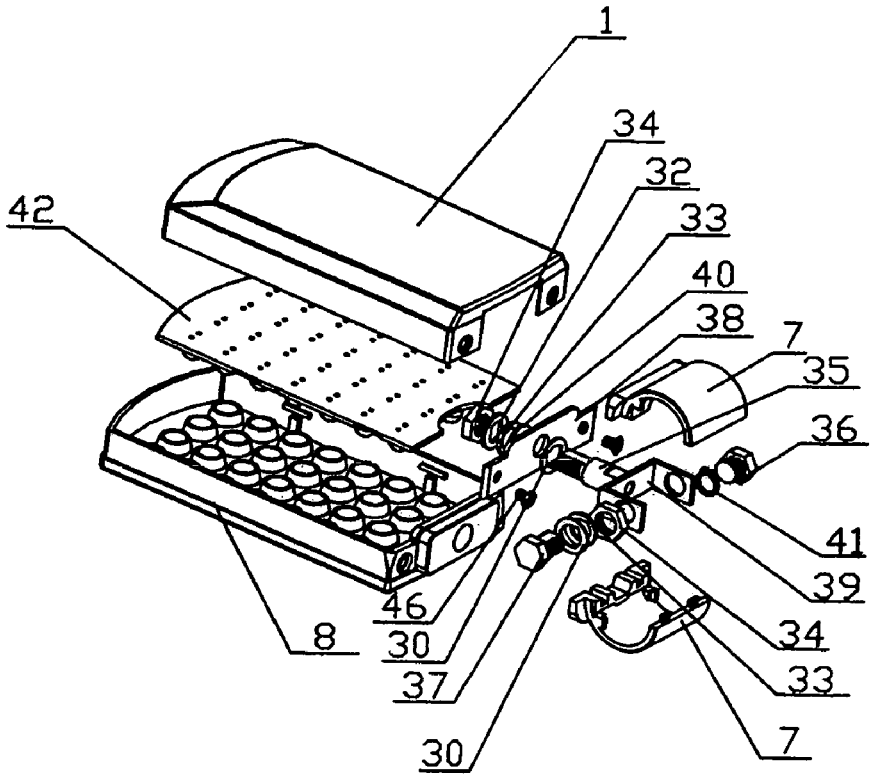
FIG. 3 is an exploded view of a head portion and a first turning structure of the reading lamp of FIG. 1.

Referring to FIG. 3, the head portion A is consisted of a cover 1, a circuit board 42 (including twenty eight semiconductor LEDs connected on the circuit board, which are arrayed as seven rows and four columns) and a motherboard 8. The motherboard 8 is provided with twenty eight subulate holes corresponding to the twenty eight semiconductor LEDs. During assembling, the semiconductor LEDs are embedded in the subulate holes, respectively. The first turning structure C is consisted of a screw turning shaft 35 two bolts 36, 37. The screw turning shaft 35 has a stator 39 on its tail. Two through holes are respectively formed in both sides of the stator 39, the bolt 37 traverses the through hole of one side of the stator 39 from outside to inside, and then a friction patch 30*a*, a dishing spring 33*a* and a bolt 34 are hitched and tweaked tightly on the tail of the bolt 37 in sequence. Similarly, the bolt 36 traverses the through hole of the other side of the stator 39, and the block spring 41 is hitched and stuck on the tail of the bolt 37, then, a friction patch 30*b*, a stator 38 on the end of the head portion a wedge 40, a dishing spring 33*b*, a fixed patch 32*a* and a screw cap 34 are hitched and tweaked tightly on the head portion of the screw turning shaft 35 in sequence. The stator 38 is fixed on the head portion A through a screw 46, upper and lower covers 7 of the turning structure C for enclosing the turning structure C, thus making the appearance thereof more fluent and pleasing.

Figure 4:
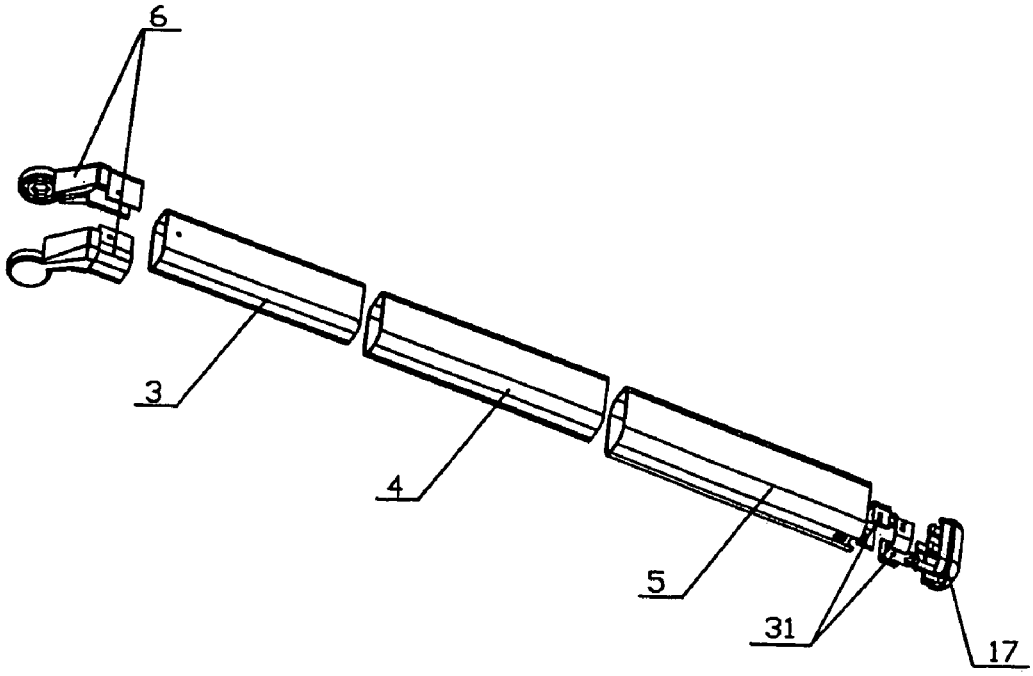
FIG. 4 is an exploded view of a pole of the reading lamp of FIG. 1.

Referring to FIG. 4, the pole B is consisted of upper-pole plugs (left, right) 6, an upper pole 3, a middle pole 4, a lower pole 5, two stators 31 and a lower-pole plug 17. The upper pole 3, the middle pole 4 and the lower pole 5 are hitched together to form a telescopic pole. The upper-pole plugs 6 is blocked in the upper pole 3, and the two bolts 36, 37 of the turning structure C are embedded in the upper-pole plugs 6 (left, right) so as to connect the head portion A with the pole B through the turning structure C. The head portion A can rotate in a range of three hundred and thirty degrees around the axis of the screw turning shaft 35, which can also be fixed in a certain angle by the dishing spring 33*b*. In addition, the head portion A and the turning structure C can also rotate around the axis of two bolts 36. 37 in a large angle. Similarly, the head portion A and the turning structure C can be fixed at a certain angle by the dishing spring 33*a*.

Figure 5:
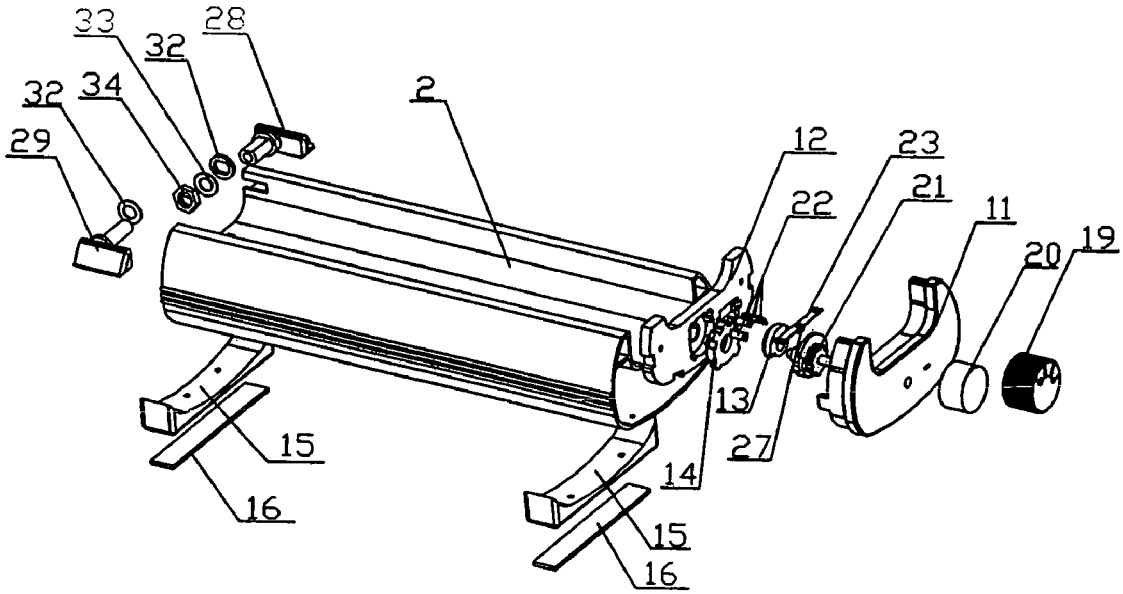
FIG. 5 is an exploded view of a base and a first turning structure of the reading lamp of FIG. 1.

Referring to FIG. 5, the second turning structure E is consisted of a base turning shaft 28 and a thread turning shaft 29. A screw cap 34, a dishing spring 33*c*, a fixed patch 32*b* and a stator 31 are hitched and tweaked on the base turning shaft 28 in sequence. The fixed patch 32*c* and another stator 31 are sequently hitched on the thread turning shaft 29. The base turning shaft 28 and the thread turning shaft 29 are embedded in the front end of the base D, respectively. Thus the pole B is connected with the base D by the turning structure B, and the pole B can rotate around the axis of the base turning shaft 28 and the thread turning shaft 29 in a large angle. The pole B can be fixed in a certain angle by the dishing spring 33*c*. The bottom surface of the base D is provided with fixed feet 15 on its front and rear end. Each of the fixed feet 15 is provided a fixed cushion 16 on its lower portion. A pole slot 2 is formed in the top of the base D for receiving the pole B. An end cover 11 is hitched at the back end of the base D. In the front of the end cover 11 and inside the base D there is a switch board 12. A switch fixed block 14, a semi-shaft 13 and a switch turning shaft 21 are provided between the end cover 11 and the switch board 12 in sequence. A switch copper sheet 22 is provided on the fixed block 14, and a switch spring plate 23 is placed on the semi-shaft 13. A steel ball 27 is provided on the switch spring plate 23. In addition, there are a knob plug 20 and a switch knob 19 on the end cover 11. The knob plug 20 is connected with the switch turning shalt 21, and the switch knob 19 encloses the knob plug 20.

Figure 6:
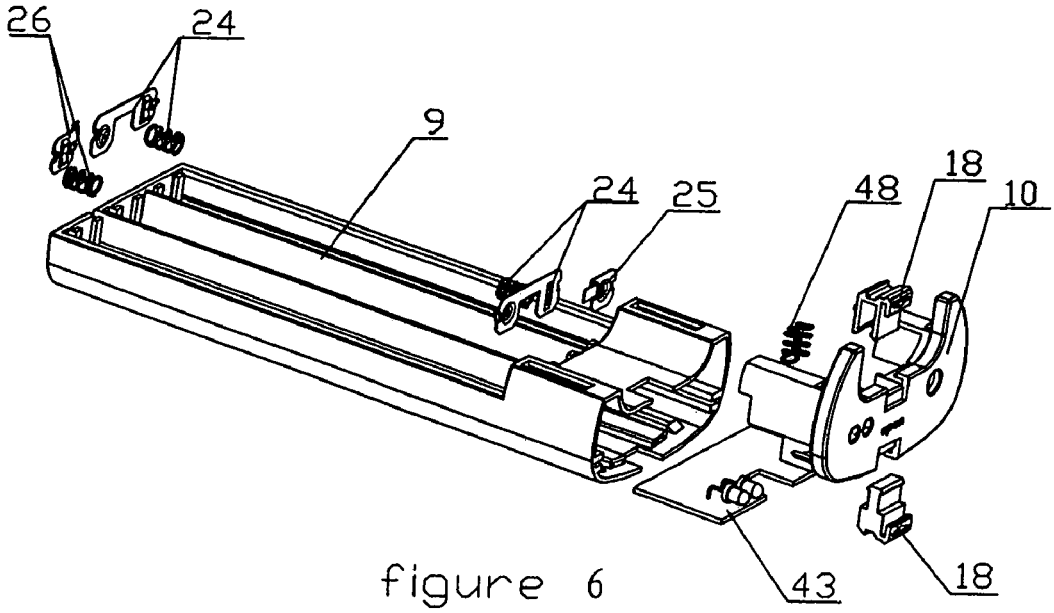
FIG. 6 is an exploded view of a battery box in the base of the reading lamp of FIG. 1.

Referring to FIG. 6, a battery box 9 is provided inside the base D which has a shape matched with the base D. An anode and cathode patch 24, an anode patch 25 and a cathode patch 26 are formed on the end of the battery box 9. Inside the battery box 9 there is also a control board 43 connected with the switch board 12. Two charge indicator lights are provided on the control board 43. There are a button slot and a button spring 48 matched with buttons 18 (upper, lower) on the end cover 10 of the battery box 9. Also, a charge jack is formed on the panel of end cover 10 for charging the charge battery. On the panel also a plurality of light holes are formed for exposing the charge indicator lights and the discharge indicator lights.

Figure 2:
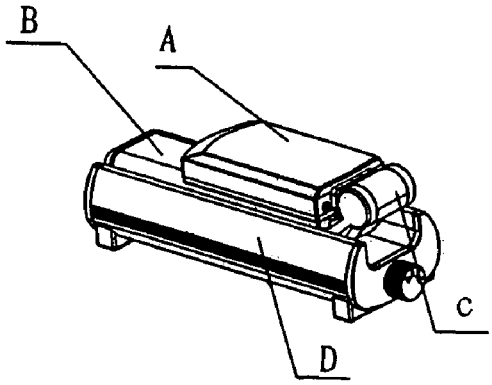
FIG. 2 is a view to show a reading lamp of the invention in a folded status.

Referring to FIG. 2, the head portion A and the pole B can be hidden inside the pole slot 2 due to the presence of the turning structure C, E and the telescopic pole B. This will greatly reduce the occupation space of the reading lamp and thus it is convenient to be taken.

Figure 7:
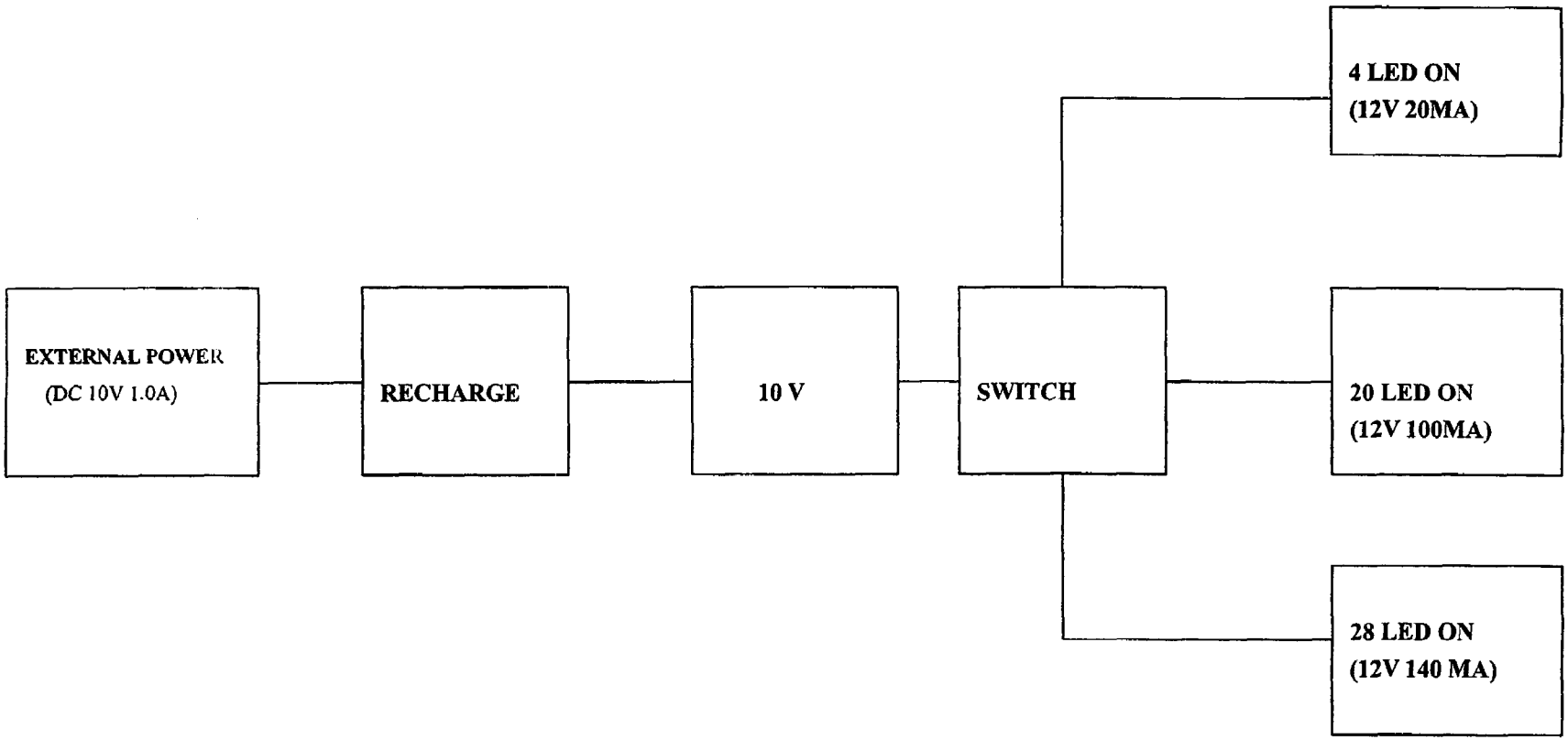
FIG. 7 is a view to show a work principle of the reading lamp of FIG. 1.

Referring to FIG. 7, the reading lamp of the invention has a work principle as follows: four charge batteries (such as three Volts) inside the battery box are charged by an external power source (such as a direct current power source with ten volts voltage and one ampere current). The voltage will arise to ten volts when finishing charge. At the time, the switch knob 19 is revolved to adjust output position with the help of the switch turning shaft 21, the semi-shaft 13, the switch fixed block 14 and the control board 43. When being adjusted to the position 1, four LEDs (twelve volts, twenty milliamperes) will be switched on; when being adjusted to the position 2, twenty LEDs (twelve volts, one hundred milliamperes) will be switched on; when being adjusted to the position 3, twenty-eight LEDs (twelve volts, one hundred and forty milliamperes) will be switched on.

It is understood that the invention may be embodied in other forms without departing from the spirit thereof. Thus, the present example and embodiment are to be considered in all respects as illustrative and not restrictive, and the invention is not to be limited to the details given herein.

What is claimed is:

1. A portable reading lamp, comprising a base;

a head portion provided with a luminant; and a telescopic pole to connect the base with the head portion, wherein a battery box is provided on the base, or the head portion or the pole for supplying direct current;

wherein the head portion and the pole are connected by a first turning structure and the first turning structure comprises:

a threaded turning shaft with two through holes which connected with the head portion;

two bolts connected with the pole;

wherein the threaded turning shaft is connected with the head portion through a friction patch, a dishing spring, a lock washer and a screw cap hitched thereon;

one of the bolt is connected with the threaded turning shaft through a friction patch, a dishing spring, a lock cushion and a screw cap hitched thereon;

the other bolt is connected with the threaded turning shaft through the block spring hitched thereon.

2. The portable reading lamp of claim 1, wherein the luminant is light emitting diodes.

3. The portable reading lamp of claim 2, wherein the head portion comprises a motherboard defining a plurality of holes and a cover, and the light-emitting diodes are embedded in corresponding holes and electrically connected to the motherboard in parallel manner.

4. The reading lamp of claim 3, wherein the holes in the motherboard are subulate holes.

5. The reading lamp of claim 2, wherein the base is provided at one end thereof with a switch means for adjusting the amount of the light emitting diodes.

6. The reading lamp of claim 1, wherein the base is provided at one end with a charger jack for charging a chargeable battery received in the base.

7. The reading lamp of claim 1, wherein the base is provided at one end with a charger indicator light and a discharge indicator light.

8. The reading lamp of claim 1, wherein the base and the pole are connected by a second turning structure, and the second turning structure comprises a threaded turning shaft and a base turning shaft both connected with the base, the threaded turning shaft is connected with the pole through a lock patch hitched thereon, the base turning shaft is connected with the pole through a lock patch, a dishing spring and a screw cap hitched thereon.

9. The reading lamp of claim 1, wherein the telescopic pole comprises at least two sleeves with different size assembled together.

10. The reading lamp of claim 1, wherein a pole slot is provided at the top of the base for receiving the pole.

* * * * *